United States Patent [19]

Hidassy

[11] 4,371,011

[45] Feb. 1, 1983

[54] ROTARY TIE CARRIER IN A BUNDLING TIE APPLYING TOOL

[75] Inventor: Laszlo Hidassy, Jamesburg, N.J.

[73] Assignee: Thomas & Betts Corporation, Raritan, N.J.

[21] Appl. No.: 203,694

[22] Filed: Nov. 3, 1980

[51] Int. Cl.[3] ..... B21F 9/02

[52] U.S. Cl. ..... 140/93.2; 140/123.6

[58] Field of Search ..... 140/38, 49, 52, 53, 140/54, 56, 57, 93 A, 93 R, 93.2, 123.6; 100/6, 26, 33 PB

[56] References Cited

U.S. PATENT DOCUMENTS

| | | | |
|---|---|---|---|
| 3,515,178 | 6/1970 | Hidassy | 140/123.6 |
| 3,891,012 | 6/1975 | Bakermans | 140/93 A |
| 3,976,108 | 8/1976 | Caveney et al. | 140/93 A |
| 4,119,124 | 10/1978 | Collier et al. | 140/93.2 |

*Primary Examiner*—Lowell A. Larson

*Attorney, Agent, or Firm*—Robert M. Rodrick; Salvatore J. Abbruzzese; Jesse Woldman

[57] ABSTRACT

A rotatable tie carrier is provided in a bundling tie applying tool, the tie carrier preferably comprising an elongate, generally cylindrical drum rotatably mounted in the tool housing. The drum has a plurality of longitudinally extending grooves thereon spaced substantially equally about the periphery of the drum. The grooves are provided to accommodate individually a plurality of ties therein. The drum is rotatably indexed to suitably advance ties individually in succession from a loading position in the tool to a feeding position whereat an individual tie is positioned in a closed loop about articles to be bundled.

9 Claims, 4 Drawing Figures

ROTARY TIE CARRIER IN A BUNDLING TIE APPLYING TOOL

FIELD OF THE INVENTION

This invention relates to a bundling tie applying tool and, more specifically, to tie carrier apparatus in such a tool for rotatably supporting ties therewithin. The present invention is particularly, but not exclusively, useful in the type of tool disclosed in copending patent application, Ser. No. 203,687, filed concurrently herewith, entitled "Bundling Tie Applying Tool," and assigned to the same assignee as is the present invention.

BACKGROUND OF THE INVENTION

Tools for applying bundling ties about wires in harnesses or about other articles are generally known and may be manual, semi-automatic or automatic. Because of high production demands, the automatic tool has become popular. The automatic tool typically includes means for positioning a bundling tie about the wires, tensioning the tie and then severing the tie upon being suitably tensioned. Ties are commonly fed into such tools from a disposable cartridge that may be mounted directly onto the tool or on a remote dispenser interconnected to the tool by a hose. In another known arrangement, a plurality of individual ties are stacked into a chamber in the tool, the ties being arranged in overlapping relation with the heads of adjacent ties being releasably joined together.

Typically, the transfer of the ties from the cartridges or chamber places the ties directly in a position to be looped about the articles. Feeding and looping of such positioned ties are effected by a piston-operated reciprocating ram or movable jaw means. With the ties being in such direct position upon being transferred, typically no other transport within the tool is needed. While such ready positioning and looping are desirable, only individual ties can be fed to the tools. Such transfer of separate and individual ties requires suitable tie transfer mechanisms, special pre-packaging of ties in a variety of cartridges for holding and maintaining suitable alignment of the separate ties or ties having complicated external head structure for providing suitable stacking before loading into a tool.

SUMMARY OF THE INVENTION

It is an object of the present invention to provide apparatus for supporting bundling ties in a bundling tie applying tool.

It is another object of the present invention to provide tie carrying apparatus in a bundling tie applying tool to advance a tie to a position for looping about articles to be bundled.

In accordance with the invention, there is provided in a bundling tie applying tool, tie carrying apparatus for advancing a tie therewithin. The tie carring apparatus comprises a rotatable tie carrier supported for rotation about an axis within the tool and means on the tie carrier for holding the tie thereon in a position aligned with such axis during rotation of the tie carrier.

In a preferred form, the tie carrier comprises an elongate, generally cylindrical member having a plurality of longitudinally extending grooves thereon for accommodating a plurality of ties individually therein. It is preferred that the grooves be spaced substantially equally about the periphery of the member. The tie carrier may be rotatably indexed in substantially equal increments.

DESCRIPTION OF THE PREFERRED EMBODIMENTS

Figure 1:
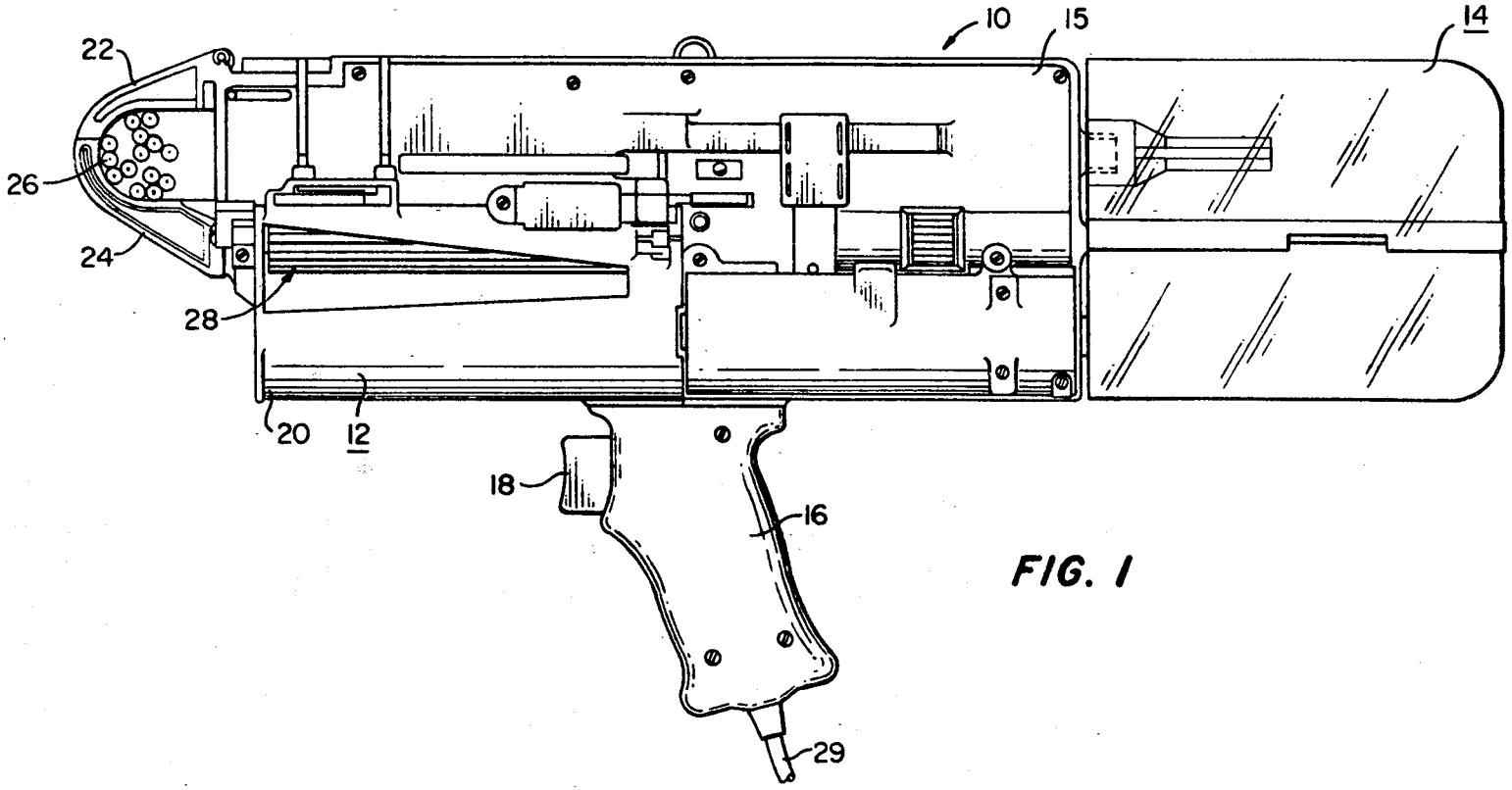
FIG. 1 is a side elevational view of a power-operated, automatic bundling tie applying tool embodying the present invention.

Referring to the drawing, there is shown in FIG. 1 an automatic bundling tie applying tool, generally indicated as numeral 10, incorporating features of the present invention. The tool 10 is preferably of the type as shown and described in copending patent application, U.S. Ser. No. 203,687, entitled "Bundling Tie Applying Tool," filed on even date herewith, and assigned to the same assignee as is the present invention. In brief, the tool 10 is an electrically powered tool capable of installing a bundling tie of the type having an apertured head portion and an elongate, flexible strap portion extending therefrom. The tool 10 has means for receiving ties individually from a series of such bundling ties interconnected between adjacent head portions by a web. Means are included in the tool 10 for advancing the ties to a separating station whereat the web between each head portion is cut thereby providing separated, individual ties. The separated ties are further advanced to a feeding station whereat a reciprocating member feeds and positions an individual bundling tie in a closed loop about the articles to be bundled. Included are means for tensioning the tie about the articles and means for severing the tensioned tie, preferably at a predetermined tension.

Generally, the tool 10 comprises a housing 12, a scrap container assembly 14 suitably attached to the rearward housing end 15 and a handle 16 with a trigger 18 mounted therein. At the forward end 20 of the housing 12 where the ties are applied to a bundle of articles, there are a pair of hook members 22 and 24. The lower hook member 24 is stationary while the upper hook member 22 is movable with respect thereto. The movable upper hook 22 is movable to a position for receipt of a plurality of wires 26 to be bundled. Once the wires 26 have been received within the confines of the hooks 22 and 24, the upper hook is closed to facilitate looping of a cable bundling tie about the wires 26. The tool 10 includes a tie carrying mechanism 28 for supporting a plurality of ties thereon and subsequently advancing the ties to a position in preparation for looping about the wires 26.

As further shown in FIG. 1, extending from the bottom portion of the handle 16 is a suitable electric cord 29 for providing electric power to the tool 10. The cord 29 is connected to a suitable source (not shown) of electrical power. The source may be a power supply capable of converting conventional line 110 volt or 220 volt alternating current to direct current for operating an electric motor housed within the tool 10. Alternatively, the source may be a battery supply capable of providing requisite direct current to the tool 10.

Figure 2:
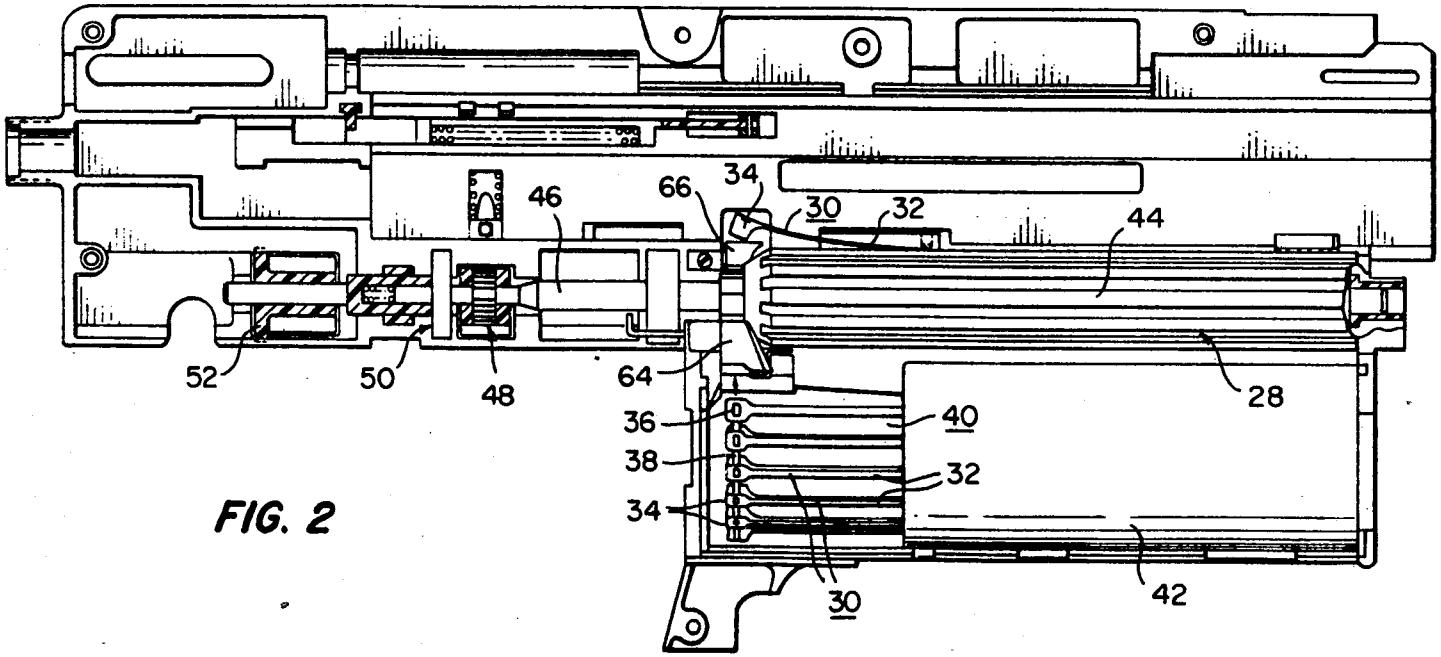
FIG. 2 is a side elevational view of the tool of FIG. 1 with the right side of the tool housing removed to expose internal tool mechanisms supported on the housing left side.

Referring now to FIG. 2, the details of the tie carrying mechanism 28 and the tie loading features for facilitating transfer of ties thereto may be appreciated. FIG. 2 shows the tool 10 from the right hand side with a portion of the right side of the housing 12 removed so as to reveal the inside of the left side of the housing and pertinent internal structure. In accordance with the preferred arrangement, the tool 10 is portable and designed to carry thereon a fixed amount of bundling ties 30, such as fifty ties or any other suitable quantity. The bundling ties 30 are of the self-locking type comprising an elongate, flexible strap portion 32 and a head portion 34 having a strap-receiving aperture 36 therethrough and may be of the type as shown and described by Noorily in U.S. Pat. No. 3,973,293, assigned to the same assignee as is the present invention. The tool 10 is adapted to receive individually a succession of ties 30 from a supply of ties that are interconnected between adjacent heads 34 by a thin, flexible web 38. The supply of interconnected ties 30 is held within a compartment 40 that is mounted on the housing 12 adjacent the tie carrying mechanism 28 for lateral transfer of the ties 30 thereto. A door 42 may be pivotably hinged to the bottom of the compartment 40 for opening to allow supplying the ties and for closing to hold the ties 30 within the compartment 40.

Referring still to FIG. 2, the tie carrying mechanism 28 comprises a rotatable tie carrier 44 in the form of an elongate drum, drum 44 being suitably mounted in the housing 12 for rotation about its longitudinal axis. The drum 44 is rigidly secured to a drum shaft 46 that is in turn coupled to an indexing mechanism 48 for automatically, rotatably indexing the drum 44 in predetermined arcs of revolution. The indexing mechanism 60 is suitably actuated by the reciprocating feeding member (not shown) for periodic rotation of the drum 44. An index centering mechanism 50 may also be coupled to the shaft 46 so as to minimize inertial override of the drum 44 during indexing and to provide precise positioning and retention of the drum 44 upon indexing. A manual rotator 52 may be coupled to the drum shaft 46 so as to provide for manual rotation and indexing of the drum 44, if desired.

Figure 3:
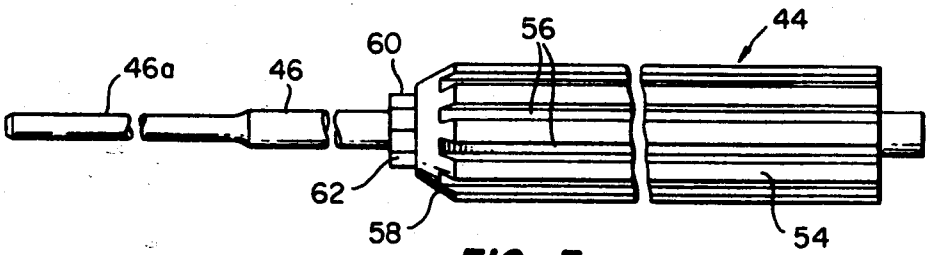
FIG. 3 is a side elevational view of a rotatable tie carrier in accordance with the present invention.
Figure 4:
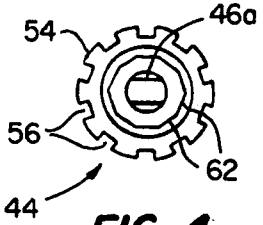
FIG. 4 is a front elevational view of the tie carrier of FIG. 3.

As illustrated in FIGS. 3 and 4, the drum 44 comprises an elongate, generally cylindrical member 54 having a plurality of longitudinally extending grooves 56 spaced about the circumference of the member 54. In the preferred form, there are ten grooves 56 spaced substantially equally about the member 54, although any suitable number of grooves may be provided. The grooves 56 are formed to have a depth greater than the thickness of the strap portion 32 and a width slightly greater than the width of the strap portion 32 for accommodating and supporting the ties 30 therein, one tie 30 to a groove 56. At the end of the drum 44, adjacent the shaft 46, the member 54 preferably has a tapered surface 58 tapering radially inwardly from the periphery of the member 54. Adjacent the tapered surface 58, the member 54 has a shoulder 60 having a diameter less than the outer periphery of the member 54. The shoulder 60 is preferably formed as a decahedron having ten substantially flat faces 62 therearound, each face 62 being aligned with one of the grooves 56. The drum 44, as described, is capable of supporting a series of interconnected ties 30 thereon wherein the strap portions 32 of the ties 30 are accommodated within the grooves 56 with the head portions 34 adjacent the flat faces 62 on the shoulder 60. The shaft 46 may be provided with one or more flat portions **46*a* for positive coupling to the indexing mechanism 48**.

As shown in FIG. 2, a tie loading mechanism 64 is mounted on the housing 12 adjacent the drum shoulder 60 and in communication with the tie holding compartment 40. The tie loading mechanism 64 is adapted to individually receive the interconnected ties 30 in succession from the feed of ties 30 held in the compartment 40 and to position the ties 30 individually in a groove 56. The ties 30 that are loaded and positioned in the grooves 56 on the drum 44 as shown in FIG. 2, are, upon indexing, collectively rotated around the drum 44 in substantially equal increments of thirty-six degrees. The grooves 56 hold each of the ties 30 respectively in an aligned position relative to the longitudinal axis of the drum 44 during rotation thereof. The interconnected ties 30 loaded and positioned in the grooves 56 at the "six o'clock" position are rotatably transported around the drum 44 in such alignment as the drum is incrementally indexed. At the "three o'clock" position, as viewed from the hook end 20 of the tool, the ties are effectively located and held along their entire lengths within the grooves 56. At this "three o'clock" position, the web 38 between adjacent heads 34 is cut. Continued rotation of the drum 44 advances separated ties 30 to the "twelve o'clock" position wherein an individual tie 30 is positioned as illustrated in FIG. 2 with its head lifted by a tie head lifter 66 for subsequent feeding to the hook end 20 for looping about the wires 26.

Although the present invention is described herein in the context of an automatic power-operated bundling tie applying tool capable of receiving a series of webbed ties and cutting the webs therein, it should be appreciated that the contemplated scope of the invention is not so limited. For example, the invention may be used in tools for applying bundling ties wherein separate ties are supplied individually to the tool from a cartridge, hose or other loading device. Moreover, the tools may also be semi-automatically operable or manual.

Various other changes to the foregoing, specifically disclosed embodiments and practices will be evident to those skilled in the art. Accordingly, the foregoing preferred embodiments are intended in an illustrative and not in a limiting sense. The true spirit and scope of the invention are set forth in the following claims.

What is claimed is:

1. In a bundling tie applying tool, tie carrying apparatus for advancing a tie positioned thereon within said tool comprising a rotatable tie carrier supported for rotation about an axis within said tool and means on said tie carrier for holding said tie thereon in a position aligned with such axis during rotation of said tie carrier.

2. Tie carrying apparatus according to claim 1, wherein said tool includes an elongate housing and wherein said tie carrier includes an elongate, generally cylindrical member positioned to extend longitudinally within said housing and to rotate about the longitudinal axis of said member.

3. Tie carrying apparatus according to claim 2, wherein said tie supporting means comprises a plurality of grooves in the periphery of said member for accommodating a plurality of said ties individually therein.

4. Tie carrying apparatus according to claim 3, wherein said grooves extend longitudinally along said member and are spaced substantially equally about the periphery of said member.

5. Tie carrying apparatus according to claim 1, further including means for rotatably indexing said tie carrier.

6. Tie carrying apparatus according to claim 5, wherein said indexing means includes means for advancing said tie carrier in substantially equal increments.

7. In a bundling tie applying tool for applying an elongate bundling tie to articles to be bundled, said tool being of the type having an elongate housing:

a movable tie carrier for supporting in spaced disposition a plurality of such bundling ties in said housing each in alignment with such housing longitudinal axis, said tie carrier having tie supporting means thereon for moving said ties collectively in such alignment during movement of said tie carrier.

8. A tool according to claim 7, wherein said tie carrier comprises an elongate member rotatable about its longitudinal axis and wherein said tie supporting means includes a plurality of tie supports lying in a substantially circular locus about the longitudinal axis of said elongate member.

9. A tool according to claim 8, wherein said tie supports are substantially equally spaced in said circular locus.

* * * * *